US010317012B2

(12) United States Patent
Ducoup et al.

(10) Patent No.: US 10,317,012 B2
(45) Date of Patent: Jun. 11, 2019

(54) METHOD FOR PRODUCING A SEALED AND THERMALLY INSULATING BARRIER FOR A STORAGE TANK

(71) Applicant: GAZTRANSPORT ET TECHNIGAZ, Saint Remy les Chevreuse (FR)

(72) Inventors: Laurent Ducoup, Boulogne Billancourt (FR); Guillaume Le Roux, Le Chesnay (FR); Virginie Longuet, Montigny-le-bretonneux (FR); Jerome Pelle, Orgerus (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 974 days.

(21) Appl. No.: 14/767,222

(22) PCT Filed: Feb. 21, 2014

(86) PCT No.: PCT/FR2014/050358
§ 371 (c)(1),
(2) Date: Aug. 11, 2015

(87) PCT Pub. No.: WO2014/128414
PCT Pub. Date: Aug. 28, 2014

(65) Prior Publication Data

US 2015/0369428 A1 Dec. 24, 2015

(30) Foreign Application Priority Data

Feb. 22, 2013 (FR) ..... 13 51569

(51) Int. Cl.
*F17C 3/02* (2006.01)
*B63B 3/68* (2006.01)
(Continued)

(52) U.S. Cl.
CPC ..... *F17C 13/001* (2013.01); *B63B 27/34* (2013.01); *F17C 3/027* (2013.01); *F17D 1/082* (2013.01);
(Continued)

(58) Field of Classification Search
CPC ..... F17C 3/022; F17C 3/025; F17C 2270/01; F17C 2270/0102; F17C 2270/0105;
(Continued)

(56) References Cited

U.S. PATENT DOCUMENTS 3,759,209 A 9/1973 Iarossi et al.
3,800,970 A * 4/1974 Jackson ..... B65D 90/023 220/560.08

(Continued)

FOREIGN PATENT DOCUMENTS

FR 2191064 6/1973

OTHER PUBLICATIONS

International Preliminary Report on Patentability, English translation issued by WIPO dated Aug. 22, 2015.

*Primary Examiner* — Frantz F Jules
*Assistant Examiner* — Erik Mendoza-Wilkenfel
(74) *Attorney, Agent, or Firm* — Notaro, Michalos & Zaccaria P.C.

(57) ABSTRACT

A method for producing a sealed and thermally insulating wall for a fluid storage tank includes attaching plural anchoring elements to a support structure; installing modular formwork elements on the support structure, the modular formwork elements having a shape that protrudes relative to the support structure and that defines, with the support structure and the plurality of anchoring parts, compartments having an open side opposite the support structure; spraying insulating foam into the compartments through the open side to form plural insulating sectors made from sprayed insu-
(Continued)

lating foam; arranging insulating junction elements in a stressed position in which they are stressed between the insulating sectors and capable of expanding when the insulating sectors contract, to ensure continuity of the thermal insulation; and attaching a sealing membrane to the anchoring elements.

18 Claims, 10 Drawing Sheets

(51) Int. Cl.

| | |
|---|---|
| ***E04F 15/14*** | (2006.01) |
| ***F17C 13/00*** | (2006.01) |
| ***B63B 27/34*** | (2006.01) |
| ***F17D 1/08*** | (2006.01) |

(52) U.S. Cl.
CPC ..... *F17C 2201/0157* (2013.01); *F17C 2201/052* (2013.01); *F17C 2203/0329* (2013.01); *F17C 2203/0333* (2013.01); *F17C 2203/0354* (2013.01); *F17C 2203/0631* (2013.01); *F17C 2209/225* (2013.01); *F17C 2209/228* (2013.01); *F17C 2209/232* (2013.01); *F17C 2221/033* (2013.01); *F17C 2223/0161* (2013.01); *F17C 2223/033* (2013.01); *F17C 2260/013* (2013.01); *F17C 2270/0107* (2013.01); *F17C 2270/0113* (2013.01); *F17C 2270/0136* (2013.01); *Y10T 29/49995* (2015.01)

(58) Field of Classification Search
CPC ..... F17C 2270/0107; F17C 2270/011; F17C 2270/0113; F17C 2270/0115; F17C 2270/0118; F17C 2270/0121; B63B 3/68; E04F 15/14; E04F 15/2016; E04F 15/02205; B29C 66/71; E01C 11/106
See application file for complete search history.

(56) References Cited

U.S. PATENT DOCUMENTS

| | | | | |
|---|---|---|---|---|
| 3,941,272 | A * | 3/1976 | McLaughlin | B63B 25/12 114/74 A |
| 5,269,247 | A * | 12/1993 | Jean | B63B 25/16 114/74 A |
| 2003/0110723 | A1* | 6/2003 | Baerveldt | E01D 19/06 52/396.04 |
| 2007/0181586 | A1* | 8/2007 | Van Ootmarsum | F17C 3/022 220/592.26 |
| 2008/0011756 | A1* | 1/2008 | Lee | F17C 13/001 220/560.13 |
| 2013/0232901 | A2* | 9/2013 | Findlay | E01C 11/126 52/396.04 |
| 2013/0326861 | A1* | 12/2013 | Gazeau | B63B 3/68 29/525.02 |
| 2015/0315800 | A1* | 11/2015 | Choy | E04F 15/08 52/396.1 |

* cited by examiner

METHOD FOR PRODUCING A SEALED AND THERMALLY INSULATING BARRIER FOR A STORAGE TANK

The invention relates to the field of sealed and thermally insulating membrane tanks for the storage and/or transportation of fluid such as a cryogenic fluid. The invention relates more particularly to the production of a sealed membrane tank in which the thermal insulation is partially formed by spraying insulating foam in situ.

Sealed and thermally insulating membrane tanks are used, notably, for the storage of liquefied natural gas (LNG). These tanks may be installed on the land or on a floating structure. In the case of a floating structure, the tank may be intended for the transportation of liquefied natural gas or for receiving liquefied natural gas used as fuel for the propulsion of the floating structure.

In the prior art, there are known methods of manufacturing such tanks from prefabricated insulating panels. These insulating panels have a layer of insulating foam, optionally reinforced with glass fibers, sandwiched between two sheets of plywood. The manufacture of a thermal insulation barrier from these prefabricated panels is a lengthy and costly process, because the prefabricated panels have to be transported and then installed one by one.

In the prior art, there is also a known method of manufacturing insulating barriers in situ against a support structure.

U.S. Pat. No. 3,759,209 discloses the production of an insulating barrier outside the hull of a ship for transporting liquefied natural gas. This document proposes attaching a formwork, composed of horizontal and vertical members defining a plurality of compartments, to the outer hull of the ship, and then placing insulating foam in the compartments. The formwork is held in place and a sealing membrane is attached to it. However, the formwork does not permit compensation for the thermal contraction of the foam, and consequently the continuity of the thermal insulation between the different foam compartments is not assured when the wall is subjected to cryogenic temperatures.

FR 2,191,064 also discloses a method of producing a tank for transporting liquefied natural gas. This document proposes attaching spacers to a support structure and then forming a grid of cables of glass fibers or metal wires which are stretched and supported by the spacers. A sheet of plywood is then attached to the tops of the spacers and an expandable urethane solution is then injected into the space between the sheet of plywood and the support structure.

The invention is based on the idea of proposing a method for producing, by foam spraying in situ, an insulating barrier for a cryogenic liquid storage tank, which, on the one hand, can be used to form a wall providing continuity of thermal insulation, and which, on the other hand, is easy to install.

According to a first aspect, the invention relates to a method for producing a sealed and thermally insulating wall for a fluid storage tank, comprising the steps of:

- attaching a plurality of anchoring elements to a support structure;
- installing modular formwork elements on the support structure, the modular formwork elements having a shape that protrudes relative to the support structure and that defines, with the support structure and the plurality of anchoring parts, compartments having an open side opposite the support structure;
- spraying insulating foam into said compartments through the open side so as to form a plurality of insulating sectors made from sprayed insulating foam;

- arranging insulating junction elements in a stressed position in which they are stressed between said insulating sectors and capable of expanding when said insulating sectors contract, so as to ensure continuity of the thermal insulation; and
- attaching a sealing membrane to said anchoring elements.

Thus this method for producing a wall benefits from the advantages of the use of a formwork, since it is simple to carry out and enables the layer of thermal insulation to be divided up so as to limit the mechanical stresses due to the temperature differences between its external and internal surfaces, while ensuring continuity of the thermal insulation when the wall is subjected to low temperatures.

In one embodiment, the method comprises a step of withdrawing the modular formwork elements. Advantageously, combined elements are placed on the support structure, a combined element comprising a modular formwork element and an insulating junction element housed, in a stressed way, within the modular formwork element, and the insulating junction element is left in the stressed position between said insulating sectors when the modular formwork elements are withdrawn. Thus the withdrawal of the modular elements and the positioning of the insulating junction elements are carried out simultaneously.

In another embodiment, combined elements are placed on the support structure, a combined element comprising a modular formwork element and an insulating junction element, the modular formwork element comprising two permanent formwork sides between which an insulating junction element is housed under stress, and releasable means for clamping the sides, and the insulating junction element, housed under stress between the two permanent formwork sides, is placed in its stressed position after the release of the side clamping means, the insulating element in its stressed position causing the two permanent formwork sides to engage with the insulating sectors between which the combined element is located.

According to other advantageous embodiments:

- The insulating junction elements are compressible.
- The compartments are adjacent to one another and every two compartments adjacent to one another are separated by a modular formwork element positioned between them.
- A modular formwork element has an anti-adhesion coating.
- An insulating junction element comprises a profiled element having two resilient flanges which, in a stressed position between the insulating sectors, are stressed toward one another and exert a reactive force tending to separate them from one another.
- The profiled element having two resilient flanges is produced from a foam made of a polymer selected from among polyurethane, melamine, polyethylene, polypropylene, polystyrene and silicone.
- An insulating junction element comprises a strip made of a compressible material selected from among glass wool, polyester wadding, and foams of polyurethane, melamine, polyethylene, polypropylene or silicone.
- The method comprises a step of trimming the insulating sectors.
- An anchoring element is a block fitted with a member for anchoring to the support structure and an element for attaching the sealing membrane, and having at least one thermally insulating layer.
- The thermally insulating layer of the block is made of polymer foam having a density of more than 100 $kg/m^3$, or of wood.

The method comprises a step of attaching anchoring plates between the adjacent anchoring blocks and a step of welding the sealing membrane onto said anchoring plates.

During the installation of modular formwork elements on the support structure, the modular formwork elements are attached to the support structure and/or to the anchoring elements.

According to a second aspect, the invention also provides a sealed and thermally insulating wall for a cryogenic fluid storage tank, made by a production process according to the first aspect of the invention.

In other words, the sealed and thermally insulating wall comprises:

a support structure;

a plurality of anchoring elements, attached to the support structure;

a plurality of insulating sectors made of insulating foam, produced by spraying insulating foam through an open side of a compartment defined by modular formwork elements, the support structure and the plurality of anchoring parts;

insulating junction elements arranged in a stressed position in which they are stressed between said insulating sectors and capable of expanding when said insulating sectors contract, so as to ensure continuity of the thermal insulation; and a sealing membrane attached to said anchoring elements.

Advantageously, the insulating sectors adhere to the support structure. Thus, because of the adhesive capacity of the sprayed foam, the insulating sectors are held in place relative to the support structure, thereby simplifying the execution of the method. This characteristic also makes it possible to prevent the insulating sectors from exerting a pressure on the membrane when the wall is a vertical wall or a ceiling.

According to a third aspect, the invention relates to a cryogenic liquid storage tank comprising at least one wall according to the second aspect of the invention.

According to one embodiment, a ship for transporting a refrigerated liquid product comprises a storage tank of the aforesaid type.

In one embodiment, the ship has a single or double hull and a tank of the aforesaid type arranged in the single or double hull.

In another embodiment, the ship has a deck and the aforesaid tank is arranged on the deck. In this case, the support structure of the tank may consist of a sheet metal structure arranged on the deck of the ship. Tanks of this type have, for example, a volume of between 5,000 and 30,000 $m^3$, and can be used for supplying fuel to engine rooms.

The tank may be used for storing liquefied natural gas at atmospheric pressure or under a relative overpressure, according to the compressive strength of the foam used, for example 3 bar for a foam having a compressive strength of 0.3 MPa.

According to one embodiment, the invention also provides a method for loading or unloading a ship of this type, in which a refrigerated liquid product is conveyed through insulated pipes from or toward a floating or land-based storage installation toward or from the ship's tank.

According to one embodiment, the invention also provides a transfer system for a refrigerated liquid product, the system comprising the aforesaid ship, insulated pipes arranged so as to connect the tank installed in the ship's hull to a floating or land-based storage installation and a pump for propelling a flow of refrigerated liquid product through the insulated pipes from or toward the floating or land-based storage installation toward or from the ship's tank.

The invention will be better understood and other objects, details, characteristics and advantages thereof will be more fully apparent from the following description of some specific embodiments of the invention, provided solely for illustrative purposes and in a non-limiting way, with reference to the attached drawings.

Conventionally, the terms "external" and "internal" are used to define the relative position of one element with respect to another, with reference to the inside and outside of the tank.

Each tank wall has, in succession, through the thickness, from the inside toward the outside of the tank, at least one sealing membrane in contact with the fluid contained in the tank, a thermally insulating barrier and a support structure. In a particular embodiment, the wall comprises two levels of sealing and thermal insulation. In this case, the wall comprises in succession, from the inside toward the outside, a primary sealing membrane, a primary insulating barrier, a secondary sealing membrane, a secondary insulating barrier, and a support structure. The terms "primary" and "secondary" are then used to describe elements belonging to the primary and secondary levels.

With reference to FIGS. 1 to 4, a method is described for producing a sealed and thermally insulating wall according to one embodiment. Sealed walls of this type can be used to produce a confinement enclosure or tank for storing and/or transporting a cryogenic fluid, such as a liquefied gas, for example methane.

Anchoring blocks 1, also called couplers, are regularly positioned and attached to an external support structure 2. This support structure 2 can, notably, be a self-supporting sheet metal structure, or, more generally, any type of rigid partition having appropriate mechanical properties, such as a concrete wall in a land-based construction.

Modular formwork elements 3 are arranged against the support structure 2 between the anchoring blocks 1. The modular formwork elements 3 thus have a shape protruding inward relative to the plane of the support structure 2. The modular formwork elements 3 form, with the anchoring blocks 1 and the support structure 2, a plurality of compartments 4. The compartments have an open side opposite the support structure 2. The modular formwork elements 3 are longitudinal beams arranged perpendicularly to one another so as to form compartments 4 in the shape of right-angled quadrilaterals. The modular formwork elements 3 can be fitted with releasable attachment members, which are described below in relation to FIGS. 19 to 26, for attaching them to the support structure 2 and/or to the anchoring blocks 1.

Figure 1:
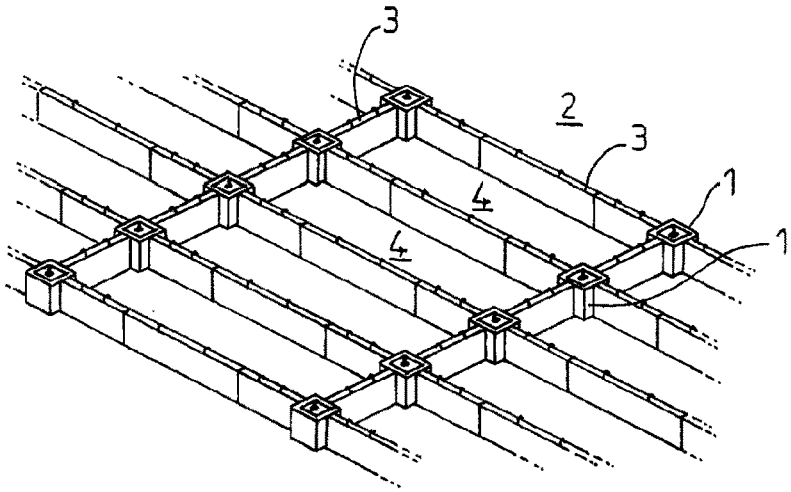
FIG. 1 is a perspective view of modular formwork elements which, together with a plurality of anchoring blocks and a support structure, define compartments for receiving the sprayed foam.
Figure 2:
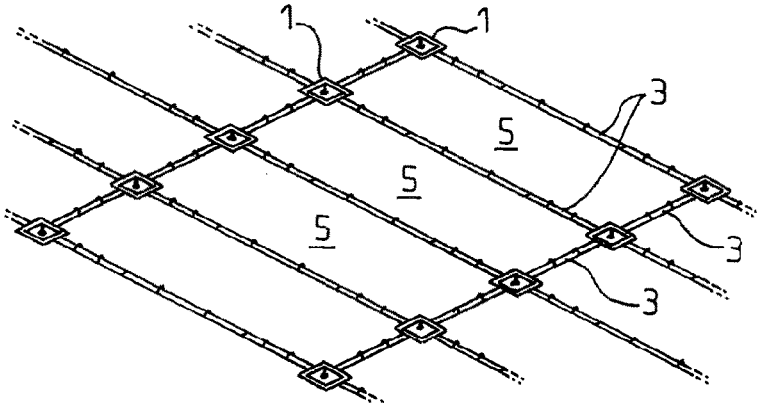
FIG. 2 is a perspective view similar to that of FIG. 1, in which foam has been sprayed into the compartments.

As shown in FIG. 2, the compartments 4 are then filled by spraying foam through the open side of the compartments, so as to form a plurality of insulating sectors 5 made from sprayed insulating foam. The compartments 4 thus create a formwork for the formation of said insulating sectors 5. The sprayed foam is, for example, a polyurethane foam. In one embodiment, short fibers, such as glass fibers, are sprayed simultaneously during the spraying of the foam. This addition of fibers helps to reduce the thermal contraction of the foam when the tank is refrigerated.

Figure 18:
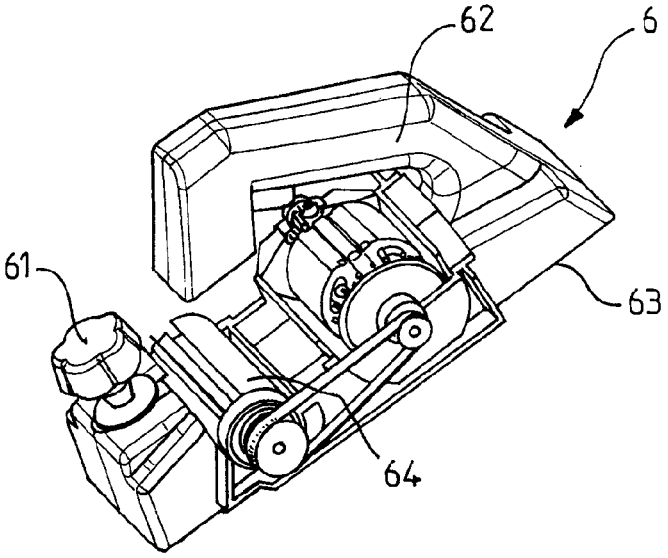
FIG. 18 is a perspective view of a plane for trimming the upper surface of the sprayed foam insulating sectors.

The internal surface of the sprayed foam insulating sectors 5 is then subjected to a trimming operation. This operation can be used to remove surface irregularities and thus level the internal surface of the insulating sectors 5. The trimming operations are, for example, carried out by means of a plane 6, shown in FIG. 18. A plane 6 of this type is typically provided with front 61 and rear 62 handles, a sole 63 for interacting with the surface to be planed, and a tool 64 placed flush with the sole 63, for treating the surface irregularities. In the embodiment, the tool 64 is a roller provided with blades or a milling cutter, rotated by a motor. In one embodiment, the planing tool is an automatic tool whose movement is guided by guide means such as cables or belts which are attached to the anchoring blocks 1. Additionally, in an advantageous embodiment, an extraction system for dust recovery is used in the trimming operations.

Figure 3:
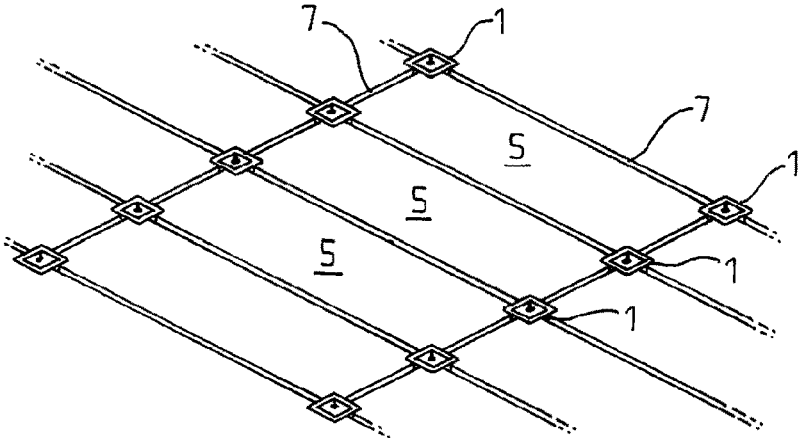
FIG. 3 is a perspective view similar to that of FIG. 2, in which the modular formwork elements have been withdrawn.

In FIG. 3, the modular formwork elements 3 are withdrawn. At this stage, the insulating sectors are separated by interstices 7 formed at the previous locations of the modular formwork elements 3.

Figure 4:
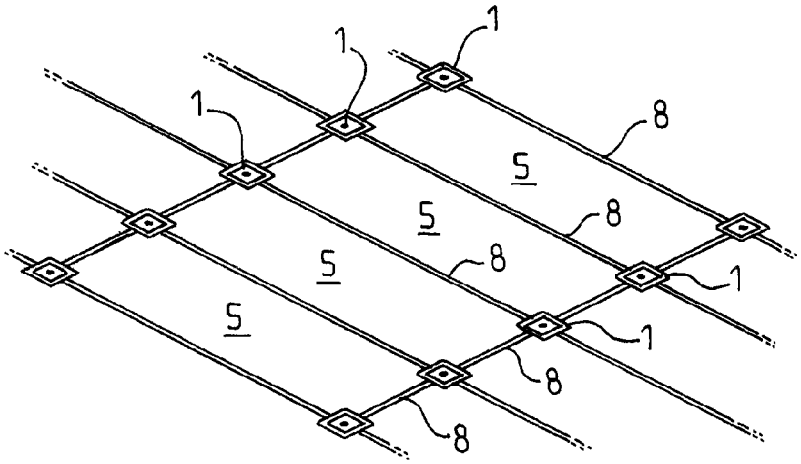
FIG. 4 is a perspective view similar to that of FIG. 3, in which the insulating junction elements have been arranged between the sprayed foam sectors.
Figure 5:
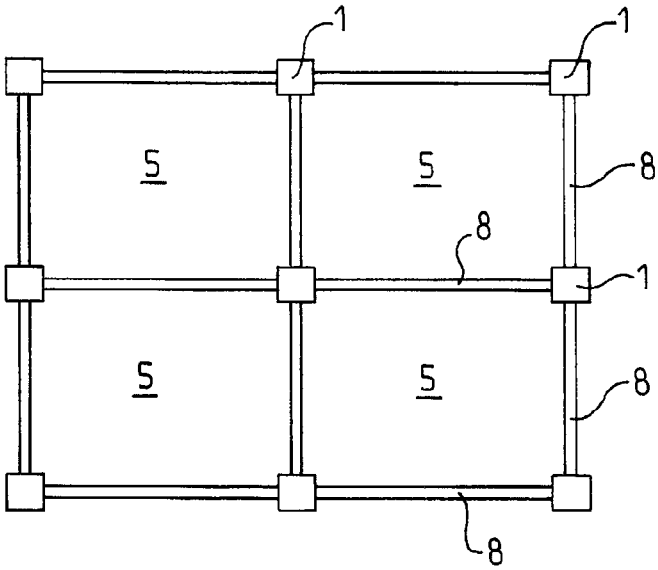
FIG. 5 is a top view showing sprayed foam sectors, anchoring blocks, and insulating junction elements arranged between said sprayed foam sectors.

To ensure the continuity of the thermal insulation, the interstices 7 between the insulating sectors 5 are lined with insulating junction elements 8, shown in FIGS. 4 and 5. The insulating junction elements 8 are also arranged at ambient temperature, under compressive stress, between the insulating sectors 5. Thus, said insulating junction elements 8 are capable of expanding and filling the gap between the insulating sectors 5 when the latter contract under the effect of low temperatures.

According to one embodiment, the insulating junction elements 8 are strips made of a flexible material such as glass fiber, polyester wadding, or foams of polyurethane (PU), melamine, polyethylene (PE), polypropylene (PP) or silicone. The width of these strips is determined so that, at ambient temperature, they are subjected to a compressive stress between the insulating sectors 5.

Figure 13:
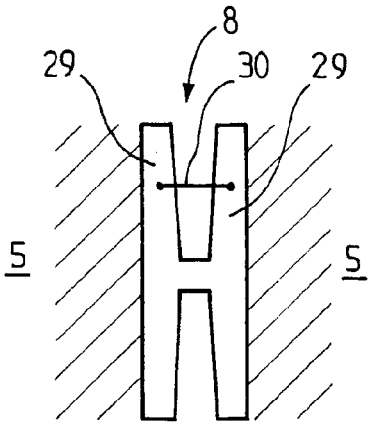
FIG. 13 is a schematic sectional view of an insulating junction element according to one embodiment.
Figure 14:
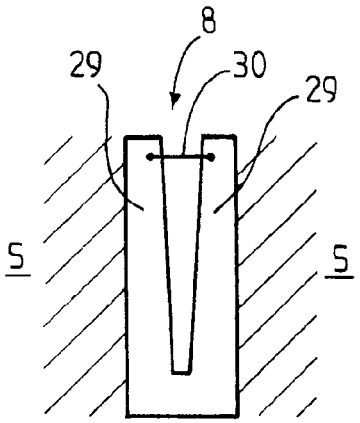
FIG. 14 is a schematic sectional view of an insulating junction element according to another embodiment.

According to other variant embodiments, shown in FIGS. 13 and 14, the insulating junction elements 8 are profiled elements having two resilient flanges 29. The resilient flanges 29 have an elasticity and dimensions such that, at ambient temperature, they are subjected to a compressive stress between the insulating sectors 5. In other words, in their stressed position, the resilient flanges 29 are stressed by the insulating sectors toward one another, and exert a reactive force tending to separate said resilient flanges 29. Said resilient flanges 29 can be connected at their centers so that the profile is substantially H-shaped (FIG. 13) or can be connected at one of their ends so that the profile is substantially U-shaped (FIG. 14). To facilitate the positioning of the insulating junction elements 8 before they are placed in the stressed position, they may be provided with releasable prestressing means. These means are, for example, ties 30 which bring the resilient flanges toward one another. After said ties 30 have been broken, the resilient flanges 29 can expand. These insulating junction elements 8 are, for example, produced from a foam made of polyurethane (PU), melamine, polyethylene (PE), polypropylene (PP), polystyrene (PS), or silicone.

To ensure the sealing of the wall, a sealing membrane 9, covering the insulating sectors 5 and the insulating junction elements 8, is attached to the anchoring blocks 1. This sealing membrane 9 is partially shown in FIGS. 9, 10 and 11. The sealing membrane 9 is composed of a plurality of sheets, welded edge to edge, the corners of which are attached by welding to the anchoring blocks 1. In a known manner, the sheets may be made of stainless steel and may have series of perpendicular corrugations for absorbing forces due to the thermal contraction of the stainless steel, or may be made of Invar®, that is to say an alloy of iron and nickel whose main property is that it has a very low coefficient of expansion.

Thus the method can be used to produce a wall comprising a sealing membrane 9 and a thermally insulating barrier. If the wall has two levels, namely a primary and a secondary level, of sealing and thermal insulation, the thermally insulated barrier and the sealing membrane 9 made in this way form secondary components, and the method is repeated with the anchoring blocks 1 and the modular formwork elements 3 arranged against the second sealing membrane 9, after which foam is injected into the compartments whose bases are formed by said secondary sealing membrane 9. Preferably, in this case, the secondary sealing membrane 9 is covered in advance with a coating to prevent the sprayed foam from adhering to the secondary sealing membrane 9, and to prevent it from creating additional mechanical stresses in this way. This coating may have low adhesion and/or low mechanical strength, so that it is ruptured when subjected to small stresses, and therefore does not transmit any large forces between the membrane and the sprayed foam.

FIGS. 6 to 11 show anchoring means according to variant embodiments.

Figure 6:
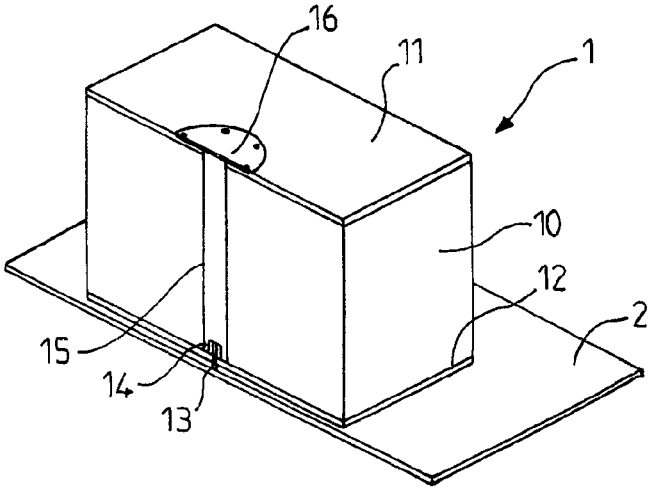
FIG. 6 is a perspective view of an anchoring block according to a first embodiment.

FIG. 6 shows an anchoring block 1 comprising a rigid thermal insulation layer 10. This rigid insulation layer 10 can, notably, be made of plywood or of insulating foam, such as a polyurethane foam, having a density of more than 100 kg/m$^3$, for example about 130 kg/m$^3$. This rigid insulation layer 10 is, in this case, sandwiched between two optional plywood panels 10, 11. A stud 13, attached to the support structure 2, by welding for example, enables the anchoring block 1 to be attached to the support structure 2. For this purpose, the external plywood panel 12 is provided with an opening for receiving said stud 13. The anchoring block 1 has a well for the insertion of a nut 14 to be screwed onto the threaded portion of the stud 13. When the nut 14 has been positioned, the well is advantageously filled with an insulating connecting piece 15 having a shape corresponding to the well. A sheet metal plate 16, enabling the corners of the sealing membrane sheet 9 to be attached by welding, is then attached to the anchoring block 1. In this case, the sheet metal plate 16 is attached to the internal plywood panel 11 by riveting.

Figure 7:
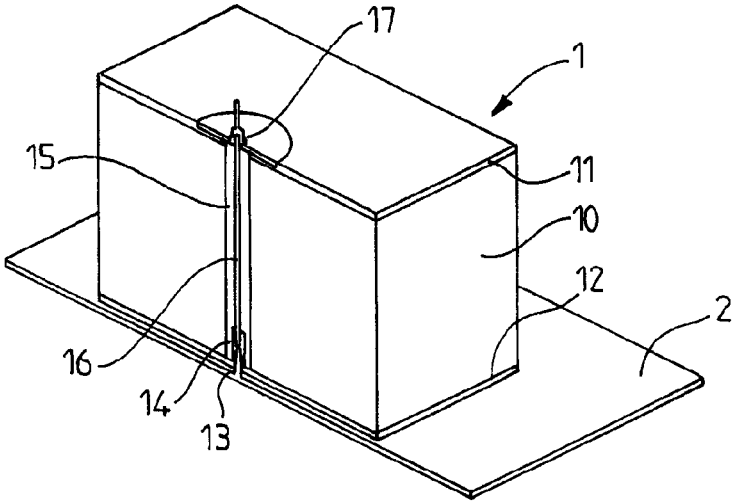
FIG. 7 is a perspective view of an anchoring block according to a second embodiment, adapted for the production of a wall having two successive levels, namely a primary and a secondary level, of sealing and thermal insulation.

FIG. 7 shows a secondary anchoring block 1, adapted for the production of a wall having two successive levels, namely a primary and a secondary level. The anchoring block 1 is attached to the support structure 2 in a similar manner to the anchoring block shown in FIG. 7. However, in this embodiment the nut 14 interacting with the threaded portion of the stud 13 also interacts with a threaded rod 16. The rod 16 passes through the insulating connecting piece 15 via a bore provided for this purpose. The rod 16 has an external end interacting by screwing with the nut 14 and an internal end carrying a metal stud 17 with a collar. The collar of the stud 17 can be used for attaching the corners of the sealing membrane sheets 9 by welding. The stud 17 can also be used to attach a primary anchoring block 1 (not shown), which is added by stacking on the secondary anchoring block 1, shown in FIG. 7. The primary anchoring block 1 can, notably, be similar to the anchoring block 1 of FIG. 6, and it is attached to the stud 17 of the anchoring block 1 of the secondary barrier in the same way as that described in relation to the stud 13 attached to the support structure 2.

Figure 10:
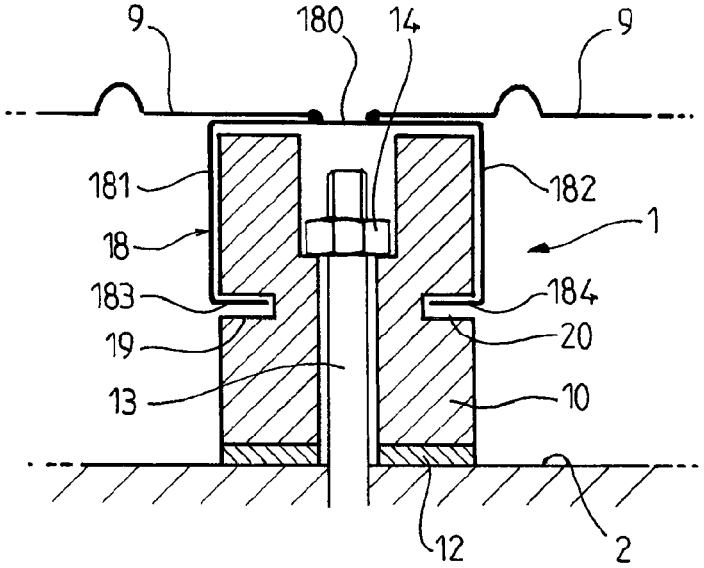
FIG. 10 is a side view of an anchoring block according to a third embodiment.

The anchoring block 1, shown in FIG. 10, comprises a rigid insulation layer 10 and an external plywood panel 12. The anchoring block 1 is also attached by means of a stud 13, attached to the support structure 2, and a nut 14 interacting with a threaded portion of said stud 13. The sheets of the sealing membrane 9 are attached by means of a metal cap 18 which is fitted on the anchoring block 1 by sliding. The cap 18 has an external face 180 prolonged by side wings 181, 182 extending on either side of said anchoring block 1. The side wings 181, 182 have bent-over edges 183, 184 sliding in grooves 19, 20 formed in the side faces of the anchoring block 1.

Figure 11:
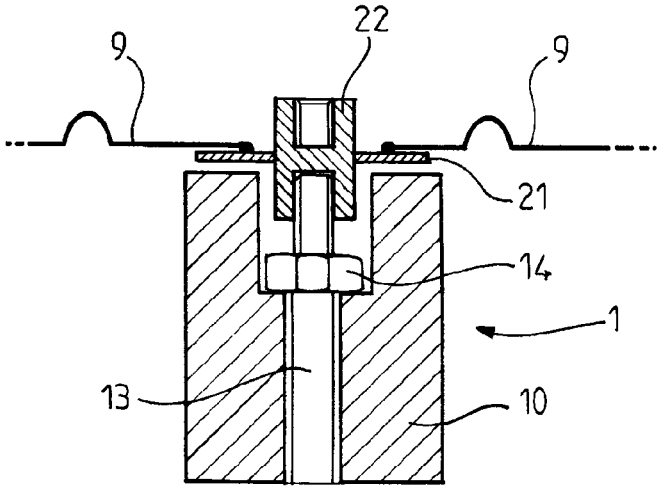
FIG. 11 is a side view of an anchoring block according to a fourth embodiment.
Figure 12:
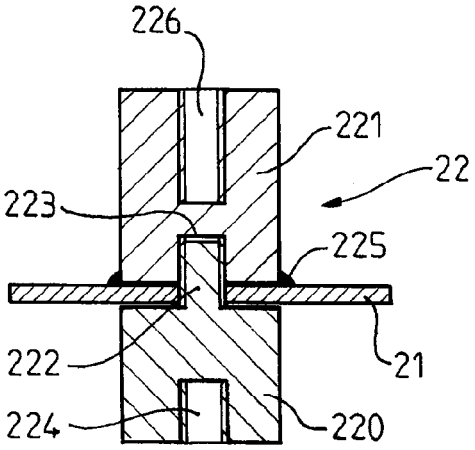
FIG. 12 is a detailed illustration of the anchoring block of FIG. 11.

FIGS. 11 and 12 show a variant embodiment of the means for supporting and for attaching, by welding, the sheets of the sealing membrane 9. In this embodiment, a metal washer 21, intended to receive the corners of sheets of sealing membrane 9, is fitted on the stud 13 by means of a sealed attachment part 22, shown in detail in FIG. 12. The sealed attachment part 22 has an internal element 220 and an external element 221. The internal element 220 has a threaded bore 224 for attaching it to the stud 13. The internal element 220 also has a threaded dowel 222 passing through an opening formed in the metal washer 21 and interacting with a threaded bore 223 formed in the external element 221. To ensure the sealing of the assembly, the external element 221 is a metal element attached by a weld bead 225 to the metal washer 21. The external element 221 is provided in this case with a bore 226 for receiving a stud for the attachment of a primary anchoring block (not shown). Advantageously, the internal element 220 can be made of a material having thermal insulation properties.

Figure 8:
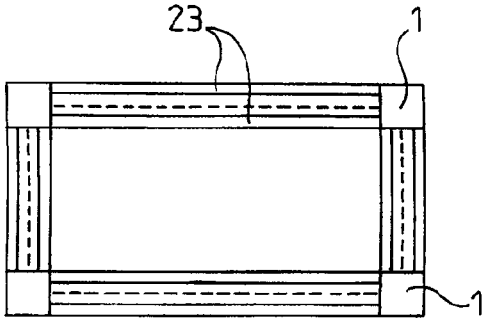
FIG. 8 is a top view showing anchoring blocks and anchoring plates for the attachment of a sealing membrane.
Figure 9:
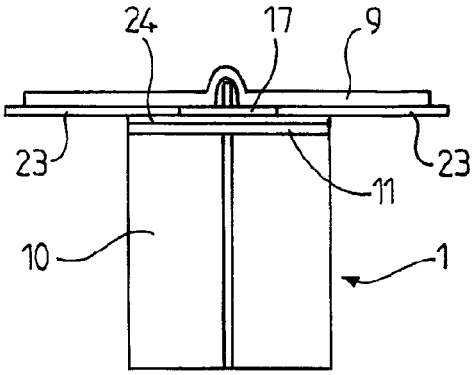
FIG. 9 is a side view of an anchoring block supporting anchoring plates.

To provide better anchoring of the sealing membrane 9, anchoring plates 23, shown in FIGS. 8 and 9, can be used. The anchoring plates 23 consist of metal strips attached to the anchoring blocks 1. The anchoring blocks 1 also have, on their internal faces, a metal plate 24 for the attachment of said anchoring plates 23. The anchoring plates 23 extend along the edges of the metal sheets of the sealing membrane 9, said edges being attached, by continuous or discontinuous welding, to the anchoring plates 23. At the junction between two adjacent metal sheets, a single anchoring plate 23 may be provided for the attachment of only one of the two metal sheets, or two anchoring plates 23 may be provided, as in FIG. 8, each of the two anchoring plates 23 being used in this case to attach a respective metal sheet of the sealing membrane 9. In one embodiment, the metal plate 24 for the attachment of said anchoring plates 23 and the collared stud 17 can be made in one piece.

Figure 15:
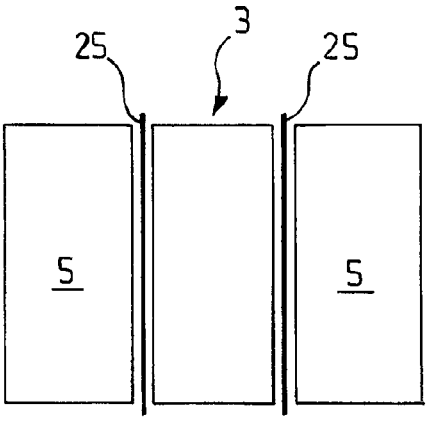
FIG. 15 is a sectional view of a modular formwork element according to one embodiment.
Figure 16:
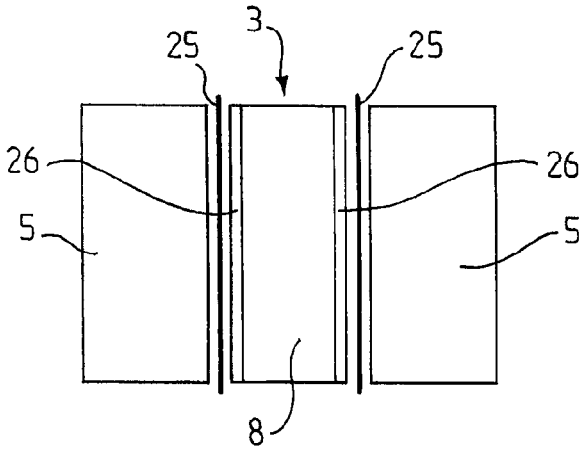
FIG. 16 is a sectional view of a modular formwork element according to a second embodiment.
Figure 17:
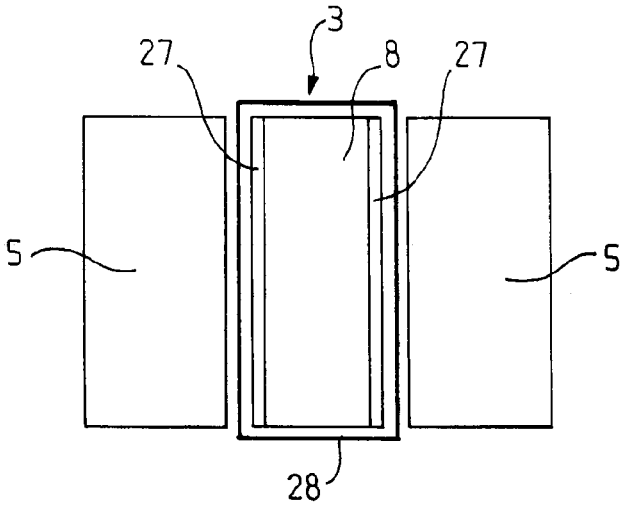
FIG. 17 is a sectional view of a modular formwork element according to a third embodiment.

FIGS. 15 to 17 show variant embodiments of the modular formwork elements.

In FIG. 15, the modular formwork element 3 is a beam of wood, metal or plastic, having an anti-adhesion coating. The anti-adhesion coating is, in this case, a film 25 which can be separated from the modular formwork element 3 when the latter is withdrawn. Alternatively, the modular formwork element 3 may be made, wholly or in part, from an anti-adhesion material such as polytetrafluoroethylene (PTFE). In this case, no film is necessary.

FIG. 16 shows a combined element comprising a modular formwork element 3 and an insulating junction element 8. These combined elements are installed on the support structure 2. The modular formwork element 3 has two sides 26 fixed to one another, between which sides an insulating junction element 8 as described above is housed under stress. When the modular formwork element 3 is withdrawn, an outward pushing force, provided for example by a pushing device which is not shown, is exerted on the insulating junction element 8 in such a way that, when the modular elements 3 are withdrawn, the insulating junction elements 8 are left between the sprayed foam insulating sectors 5. As in the previous case, the insulating junction elements 8 are stressed, at ambient temperature, between the insulating sectors 5 and are capable of expanding so as to fill the gap due to the thermal contraction of the insulating sectors 5 when the tank is refrigerated.

A combined element comprising a modular formwork element 3 and an insulating junction element 8 is shown in FIG. 17. This combined element is used in a different way from the combined element of FIG. 16, since it is intended to remain, at least partially, permanently in the wall. The modular element 3 has two permanent formwork sides 27, between which sides an insulating junction element 8 is housed under stress. Since the sides 27 are intended to form an integral part of the thermally insulating barrier, they are made of an insulating material, such as plywood. The modular formwork element 3 comprises releasable means for clamping the sides, these means being ties 28 in the illustrated embodiment. When the foam has been sprayed and the insulating sectors 5 have been formed, the ties 28 can then be cut so as to release the insulating junction element 8. This element is then in a stressed position, being compressed between the insulating sectors 5, in which it can expand when thermal contraction of the sprayed foam insulating sectors 8 takes place.

FIGS. 19 to 26 show releasable members for attaching the modular formwork elements 3. These attachment members can be used to attach the modular formwork elements 3, notably for the production of vertical walls or the ceiling of the tank. Evidently, the attachment members must be releasable to allow the withdrawal of said modular formwork elements 3.

Figure 19:
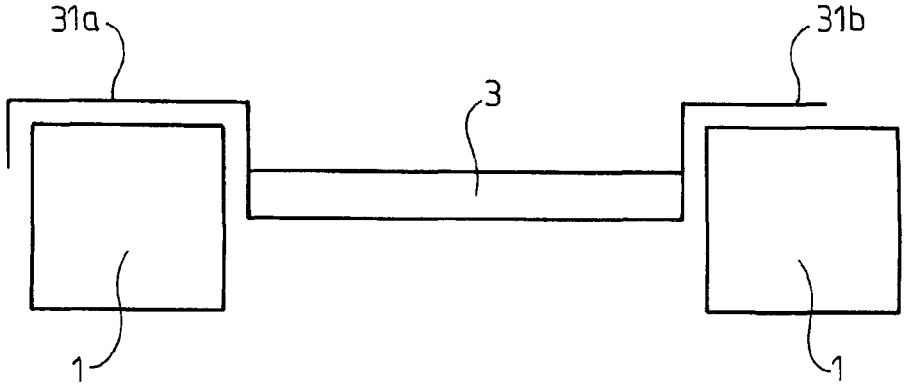
FIG. 19 is a schematic representation showing anchoring blocks and a modular formwork element fitted with members for attachment to the anchoring blocks.

In FIG. 19, the modular formwork element 3 is fitted with lugs 31*a*, 31*b* for attachment to the anchoring blocks 1 according to two variant embodiments. The attachment lugs 31*a*, 31*b* are profiled parts, having profiles with a shape complementary to at least a portion of the profile of said anchoring blocks 1. The attachment lugs 31*a*, 31*b* are arranged so as to interact with the upper face of the anchoring blocks 1, and thus form hooks for retaining the modular formwork elements 3. The attachment lugs 31*a*, 31*b* can be made of metal or plastic.

In one embodiment which is not shown, the attachment members may comprise ties for attaching the modular formwork elements 3 to the anchoring blocks 1.

Figure 20:
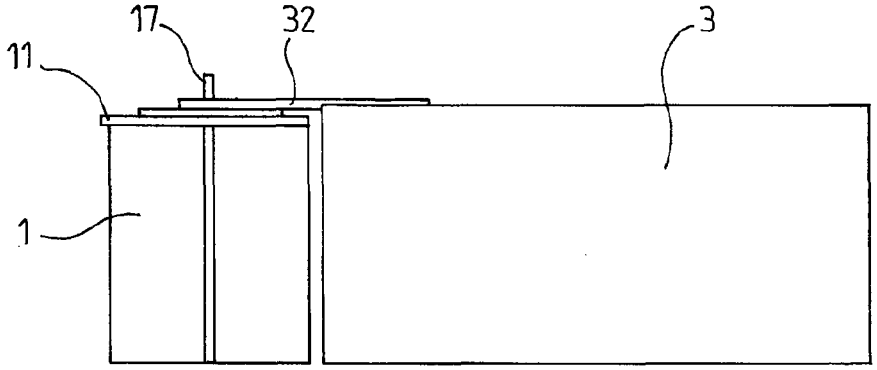
FIG. 20 is a side view showing an anchoring block and a modular formwork element provided with members for attachment to said anchoring block, according to one embodiment.

In FIG. 20, the modular formwork element 3 comprises an attachment lug 32 provided with an opening intended to receive a stud 17 projecting from the internal face of the anchoring block 1. Advantageously, the stud 17 for attaching the modular formwork elements 3 can also serve to attach said anchoring block 1 to the support structure 2. The stud 17 can comprise a threaded portion so as to allow the fitting of a nut (not shown) adapted to retain the attachment lug 32 against the internal face of the anchoring block 1.

Figure 21:
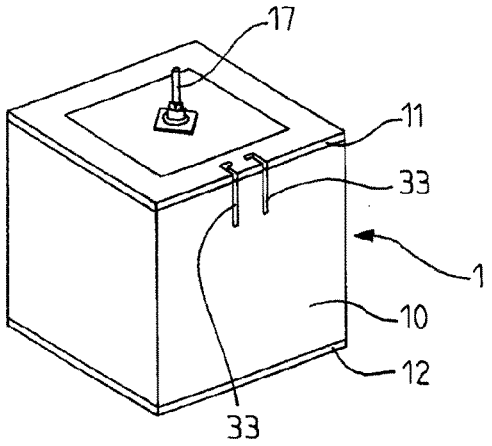
FIG. 21 is a perspective view showing an anchoring block provided with grooves for attaching modular formwork elements, according to another embodiment.
Figure 22:
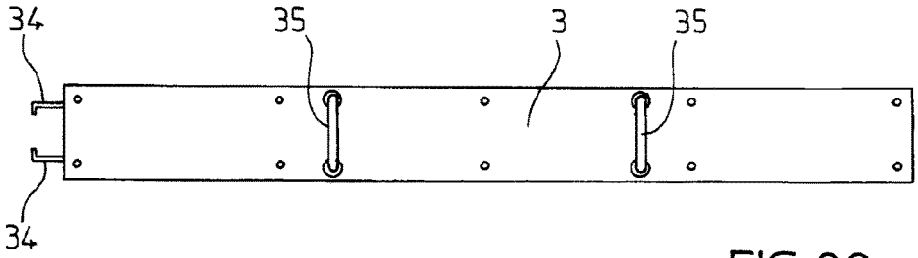
FIG. 22 is a top view of a modular formwork element provided with attachment lugs intended to interact with the grooves of the anchoring block shown in FIG. 21.
Figure 23:
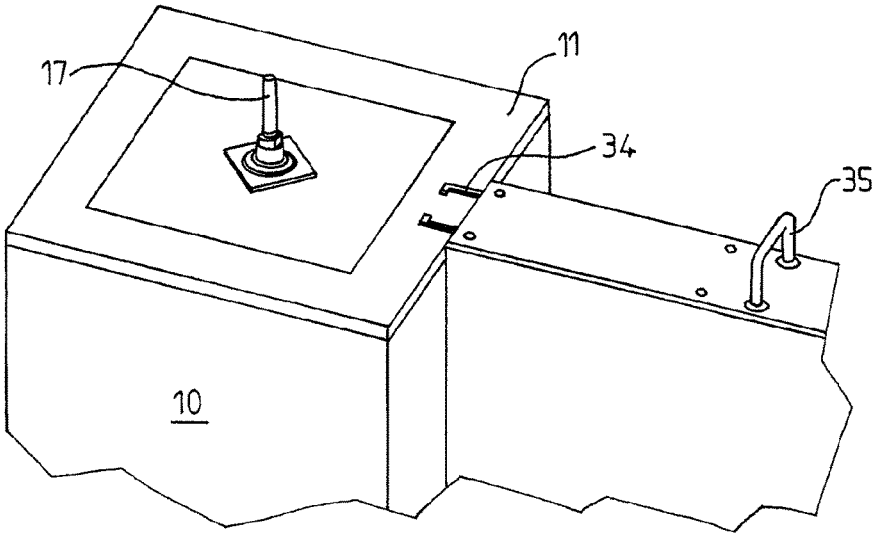
FIG. 23 is a perspective view showing the attachment between the anchoring block of FIG. 21 and the modular formwork element of FIG. 22.

In the embodiment of FIGS. 21 to 23, the anchoring block 1 has two grooves 33 adapted to receive two lugs 34 having complementary shapes, formed at one or more of the ends of the modular formwork elements 3. The grooves 33 open onto the internal faces of the anchoring blocks 1.

It should also be noted that, in this embodiment, the modular formwork elements 3 are fitted with handles 35 to facilitate their handling and placing against the support structure 2.

Figure 24:
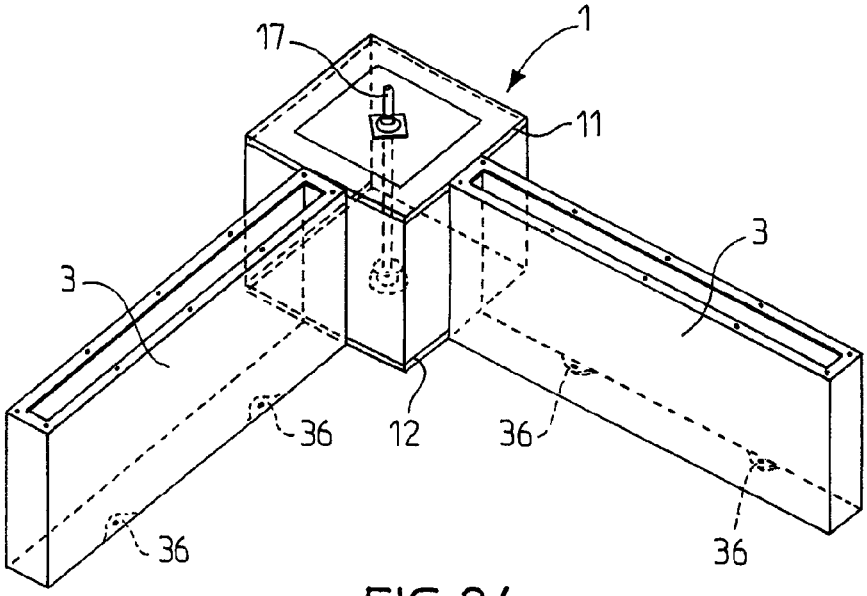
FIG. 24 is a perspective view showing modular formwork elements fitted with members for attachment to the support structure.
Figure 25:
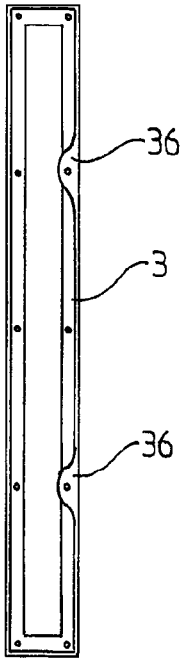
FIG. 25 is a view from the outside of a modular formwork element of FIG. 24.
Figure 26:
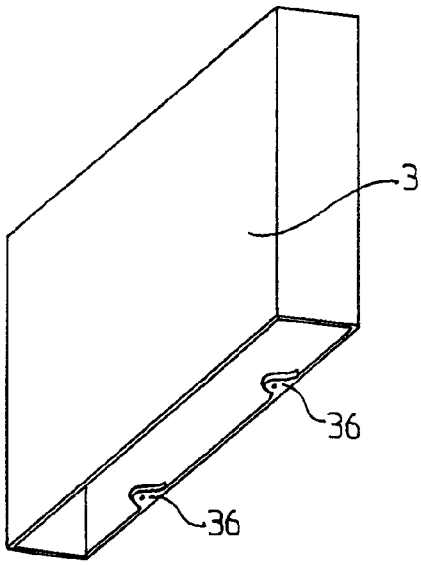
FIG. 26 is a perspective view of a modular formwork element of FIG. 24.

In the embodiment of FIGS. 24 to 26, the modular formwork elements 3 are fitted with members for attachment to the support structure 2. In this case, the members for attachment to the support structure have tabs 36 formed on the external faces of the modular formwork elements 3. The tabs 36 are provided with openings intended to receive studs which are attached, by welding for example, to the support structure 2. Each of the studs is advantageously threaded so as to receive a nut. In this case, the modular formwork elements 3 are at least partially hollow, so as to allow access to the nuts via their internal faces.

The method of producing a wall described above can be used for producing one or more or all of the walls of a sealed thermally insulating tank for storing and/or transporting cryogenic fluid.

According to one embodiment, the method is applied to a flat load-bearing wall installed horizontally. When the insulating barrier and the sealing membrane have been installed on this flat wall, it forms a sealed insulating wall which can be manipulated as a single piece. It is then possible to produce a polyhedral tank by assembling a plurality of load-bearing walls, assembled to one another, to form a tank, the walls being, for example, a bottom wall, side walls and a ceiling wall. The method can then be used to produce the insulating barrier and the sealed membrane on each of the load-bearing walls.

A tank of this type may form part of a land-based storage installation, for storing LNG for example, or may be installed in a floating structure in coastal or deep waters, notably in a gas carrier ship, a floating storage and regasification unit (FSRU), a floating production and storage and offloading unit (FPSO), or others.

Figure 27:
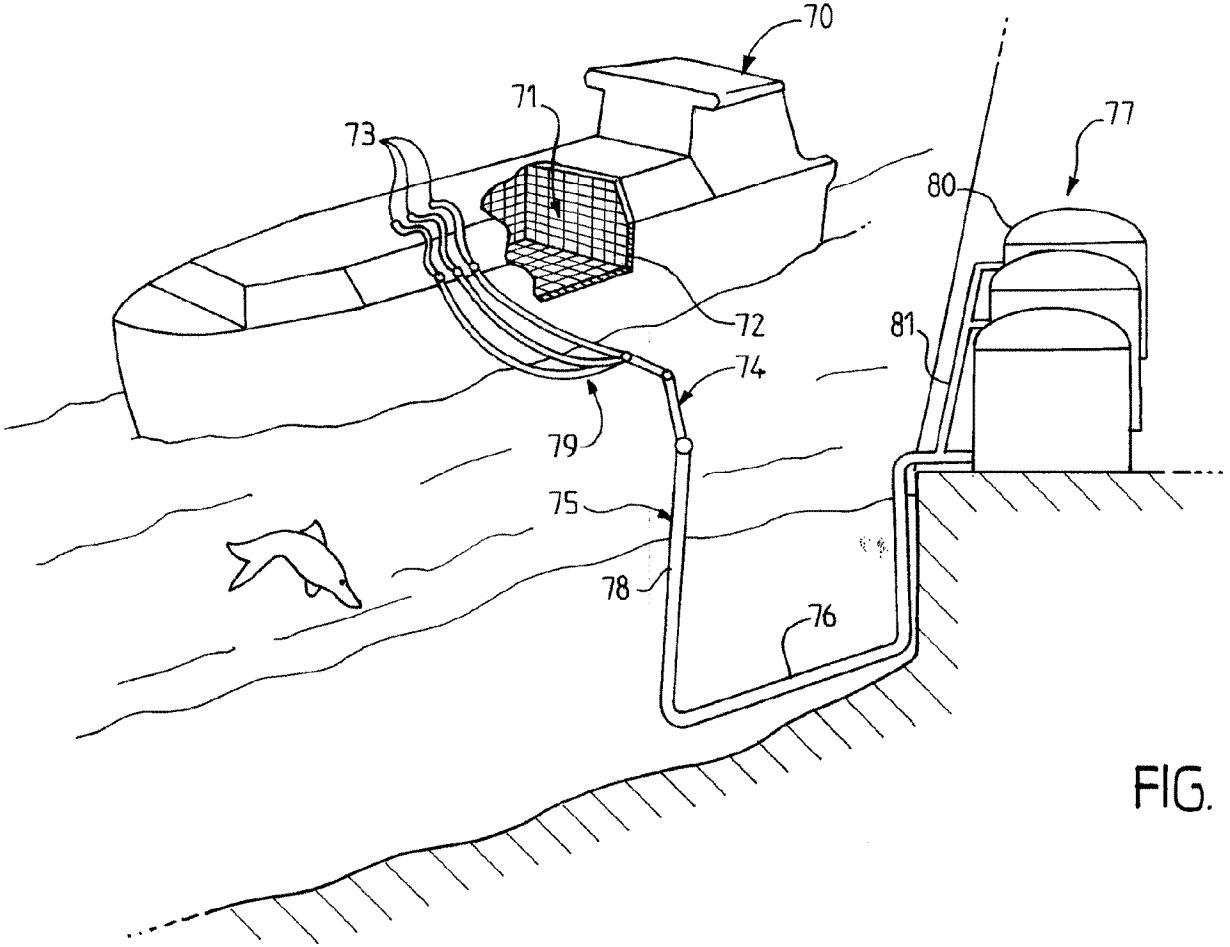
FIG. 27 is a schematic cutaway view of a tank of a natural gas carrier and a terminal for loading and/or unloading this tank.

With reference to FIG. 27, a cutaway view of a gas carrier ship 70 shows a sealed insulated tank 71 of generally prismatic shape mounted in the double hull 72 of the ship. The wall of the tank 71 comprises a primary sealed barrier intended to be in contact with the LNG contained in the tank, a secondary sealed barrier arranged between the primary sealed barrier and the double hull 72 of the ship, and two insulating barriers arranged, respectively, between the primary sealed barrier and the secondary sealed barrier, and between the secondary sealed barrier and the double hull 72.

In a known way, loading/unloading pipes 73 positioned on the upper deck of the ship can be connected, using appropriate connectors, to a marine or port terminal for transferring a cargo of LNG from or to the tank 71.

FIG. 27 shows an example of a marine terminal comprising a loading and unloading station 75, a submarine pipe 76 and a land-based installation 77. The loading and unloading station 75 is a fixed off-shore installation comprising a movable arm 74 and a tower 78 supporting the movable arm 74. The movable arm 74 carries a bundle of insulated flexible hoses 79 that can be connected to the loading/unloading pipes 73. The movable arm 74, which can be oriented as required, is suitable for all sizes of gas carriers. A connecting pipe which is not shown extends inside the tower 78. The loading and unloading station 75 enables the gas carrier 70 to be loaded and unloaded from or to the land-based installation 77. The latter comprises liquefied gas storage tanks 80 and connecting pipes 81 linked by the submarine pipe 76 to the loading and unloading station 75. The submarine pipe 76 enables the liquefied gas to be transferred between the loading and unloading station 75 and the land-based installation 77 over a long distance, for example 5 km, allowing the gas carrier ship 70 to be kept at a long distance from the shore during the loading and unloading operations.

In order to generate the pressure required for transferring the liquefied gas, pumps on board the ship 70 and/or pumps fitted in the land-based installation 77 and/or pumps fitted in the loading and unloading station 75 are used.

Although the invention has been described with reference to particular embodiments, it is evidently not limited in any way to these embodiments, and comprises all the technical equivalents of the means described and their combinations where these fall within the scope of the invention.

The use of the verb "to have", "to comprise" or "to include" and any of its conjugated forms does not exclude the presence of elements or steps other than those stated in a claim. The use of the indefinite article "a" for an element or a step does not exclude the presence of a plurality of such elements or steps unless otherwise specified.

In the claims, any reference symbol in brackets is not to be interpreted as a limitation of the claim.

The invention claimed is:

1. A method for producing a sealed and thermally insulating wall for a fluid storage tank, comprising the steps of:

attaching a plurality of anchoring elements (1) to a support structure (2);

installing modular formwork elements (3) on the support structure (2), the modular formwork elements (3) having a shape that protrudes relative to the support structure (2) and that defines, with the support structure (2) and the plurality of anchoring elements (1), mutually adjacent compartments (4) having an open side opposite the support structure (2), two mutually adjacent compartments being separated in each case by one of the modular formwork element positioned between the two mutually adjacent compartments;

spraying insulating foam into said compartments (4) through the open side so as to form a plurality of insulating sectors (5) made from sprayed insulating foam withdrawing the modular formwork elements (3);

arranging compressible insulating junction elements (8) in place of the modular formwork elements (3), the insulating junction elements (8) being arranged in a stressed position in which the compressible insulating junction elements (8) are compressed between said insulating sectors (5) and capable of expanding when said insulating sectors (5) contract, so as to ensure continuity of a thermal insulation layer comprising the insulating junction elements (8) and the insulating sectors (5); and attaching a sealing membrane (9) to said anchoring elements (1).

2. A method for producing a sealed and thermally insulating wall for a fluid storage tank, comprising the steps of:

attaching a plurality of anchoring elements (1) to a support structure (2);

installing combined elements on the support structure (2), each combined element comprising one of the modular formwork elements (3) and a compressible insulating junction element (8) housed under stress in a compressed way within the modular formwork element (3); the modular formwork elements (3) having a shape that protrudes relative to the support structure (2) and that defines, with the support structure (2) and the plurality of anchoring elements (1), mutually adjacent compartments (4) having an open side opposite the support structure (2), two mutually adjacent compartments being separated in each case by one of the modular formwork elements positioned between the two mutually adjacent compartments;

spraying insulating foam into said compartments (4) through the open side so as to form a plurality of insulating sectors (5) made from sprayed insulating foam;

withdrawing the modular formwork elements (3); the insulating junction elements (8) being left, in a stressed position, between said insulating sectors (5) when the modular formwork elements (3) are withdrawn, the insulating junction elements (8) being, in their stressed position, compressed between said insulating sectors (5) and capable of expanding when said insulating sectors (5) contract, so as to ensure continuity of a thermal insulation layer comprising the insulating junction elements (8) and the insulating sectors (5); and attaching a sealing membrane (9) to said anchoring elements (1).

3. A method for producing a sealed and thermally insulating wall for a fluid storage tank, comprising the steps of:

attaching a plurality of anchoring elements (1) to a support structure (2);

installing combined elements on the support structure (2), each combined element comprising one of the modular formwork elements (3) and a compressible insulating junction element (8), the modular formwork element (3) comprising two permanent formwork sides (27) between which one of the insulating junction elements (8) is housed under stress, and releasable means (28) for clamping the sides (27), these releasable means (28) for clamping the sides (27) being capable of clamping the two permanent formwork sides (27) against the insulating junction element (8) in a non-released state and of no longer clamping the two permanent formwork sides (27) in a released state; the modular formwork elements (3) having a shape that protrudes relative to the support structure (2) and that defines, with the support structure (2) and the plurality of anchoring elements (1), mutually adjacent compartments (4) having an open side opposite the support structure (2), two mutually adjacent compartments being separated in each case by one of the modular formwork elements (3) positioned between the two mutually adjacent compartments;

spraying insulating foam into said compartments (4) through the open side so as to form a plurality of insulating sectors (5) made from sprayed insulating foam;

releasing the releasable means (28) for clamping the sides (27) so as to place the insulating junction elements (8) in a stressed position in which the insulating junction elements (8) are compressed between said insulating sectors (5) and capable of expanding when said insulating sectors (5) contract, so as to ensure continuity of a thermal insulation layer comprising the insulating junction elements (8) and the insulating sectors (5); each insulating junction element (8), in its stressed position, causing the two permanent formwork sides (27) of the combined element to which it belongs to engage with the insulating sectors (5) between which said two permanent formwork sides are located; and attaching a sealing membrane (9) to said anchoring elements (1).

4. The production method as claimed in claim 1, wherein a modular formwork element (3) has an anti-adhesion coating (25).

5. The production method as claimed in claim 1, wherein an insulating junction element (8) comprises a profiled element having two resilient flanges (29) which, in a stressed position between the insulating sectors (5), are stressed toward one another and exert a reactive force tending to separate them from one another.

6. The production method as claimed in claim 5, wherein the profiled element having two resilient flanges is produced from a foam made of a polymer selected from among polyurethane, melamine, polyethylene, polypropylene, polystyrene and silicone.

7. The production method as claimed in claim 1, wherein an insulating junction element (8) comprises a strip made of a compressible material selected from among glass wool, polyester wadding, and foams of polyurethane, melamine, polyethylene, polypropylene or silicone.

8. The production method as claimed in claim 1, comprising a step of trimming the insulating sectors (5).

9. The production method as claimed in claim 1, wherein an anchoring element is a block (1) fitted with a member (13, 14) for anchoring to the support structure (2) and an element (16, 17, 18, 21) for attaching the sealing membrane (9), and having at least one thermally insulating layer (10).

10. The production method as claimed in claim 8, wherein the thermally insulating layer (10) of the block (1) is made of polymer foam having a density of more than 100 kg/m3, or of wood.

11. The production method as claimed in claim 9, comprising a step of attaching anchoring plates (23) between the adjacent anchoring blocks (1) and a step of welding the sealing membrane (9) onto said anchoring plates (1).

12. The production method as claimed in claim 1, wherein, during the installation of modular formwork elements (3) on the support structure (2), the modular formwork elements (3) are attached to the support structure (2) and/or to the anchoring elements (1).

13. A sealed and thermally insulating wall for a cryogenic fluid storage tank, made by a production process as claimed in claim 1, comprising:

a support structure;

a plurality of anchoring elements, attached to the support structure;

a plurality of insulating sectors made of insulating foam, produced by spraying insulating foam through an open side of a compartment defined by modular formwork elements, the support structure and the plurality of anchoring parts;

insulating junction elements arranged in a stressed position in which they are stressed between said insulating sectors and capable of expanding when said insulating sectors contract, so as to ensure continuity of the thermal insulation; and a sealing membrane attached to said anchoring elements.

14. The wall as claimed in claim 13, wherein the insulating sectors (5) adhere to the support structure (2).

15. A liquid storage tank comprising at least one wall as claimed in claim 14.

16. A ship (70) for transporting a refrigerated liquid product, the ship comprising a tank (71) as claimed in claim 15.

17. A method for loading or unloading a ship (70) as claimed in claim 16, wherein a refrigerated liquid product is conveyed through insulated pipes (73, 79, 76, 81) from or to a floating or land-based storage installation (77) to or from the tank of the ship (71).

18. A transfer system for a refrigerated liquid product, the system comprising a ship (70) as claimed in claim 16, insulated pipes (73, 79, 76, 81) arranged so as to connect the tank (71) installed in the ship's hull to a floating or land-based storage installation (77), and a pump for propelling a flow of refrigerated liquid product through the insulated pipes from or to the floating or land-based storage installation to or from the ship's tank.

* * * * *